United States Patent [19]

Pretty

[11] 4,157,066

[45] Jun. 5, 1979

[54] PRESSES HAVING PLATEN LEVELING MEANS

[75] Inventor: Frederick A. Pretty, Alveston, England

[73] Assignee: USM Corporation, Farmington, Conn.

[21] Appl. No.: 897,782

[22] Filed: Apr. 19, 1978

[30] Foreign Application Priority Data

Apr. 22, 1977 [GB] United Kingdom ..... 16726/77

[51] Int. Cl.[2] ..... B30B 15/24

[52] U.S. Cl. ..... 100/46; 91/171; 100/258 A; 100/269 R

[58] Field of Search ..... 100/46, 258, 258 A, 100/48, 269 R; 72/453; 91/171

[56] References Cited

U.S. PATENT DOCUMENTS

| | | | |
|---|---|---|---|
| 2,343,167 | 2/1944 | Bench | 100/46 |
| 2,377,007 | 5/1945 | Hess | 100/46 |
| 2,484,908 | 10/1949 | Purcell | 100/46 |
| 2,753,689 | 7/1956 | Biggert | 100/46 X |
| 3,059,431 | 10/1962 | Munschauer | 91/171 |

*Primary Examiner*—Billy J. Wilhite

*Attorney, Agent, or Firm*—Aubrey C. Brine; Richard B. Megley; Vincent A. White

[57] ABSTRACT

Hydraulic mechanism controlling approach and separation of relatively movable platens of a press is provided to maintain them in parallel relation. If one of two columns of the press advances relative to the other, the advanced column is slowed by restricting fluid flow return from its cylinder. Diagonally opposite cylinders in a four-column press are thus controlled.

3 Claims, 2 Drawing Figures

PRESSES HAVING PLATEN LEVELING MEANS

BACKGROUND OF THE INVENTION

This invention is concerned with improvements in or relating to fluid pressure actuated presses.

In carrying out many different kinds of pressing operation, it is necessary to maintain platens of the press substantially parallel to one another. For example, when a press is used to cut a workpiece by pressing a cutting edge of a die through the workpiece, it is necessary for the platens to be substantially parallel if complete penetration of the workpiece is to be achieved.

In United Kingdom Pat. No. 1,035,816, there is described a press in which an upper platen is moved by two piston and cylinder assemblies and is maintained parallel to a lower platen of the press by valve balancing means. The valve balancing means operates, in response to an advance of a portion of the upper platen connected to one of the assemblies relative to a portion of the upper platen connected to the other assembly, to reduce the supply of hydraulic fluid to the assembly connected to the advanced portion by bleeding the hydraulic fluid to a collecting tank so that the operation of that assembly is slowed and a compensating advance of the other portion of the upper platen is caused to occur. However, this arrangement is wasteful in that much hydraulic fluid may be pumped straight to the tank without being used in a pressing operation with a consequent waste of the energy used to pump this fluid.

SUMMARY OF THE INVENTION

It is one of the various objects of the present invention to provide an improved hydraulically-operated press in which platens are maintained substantially parallel to one another without the necessity for pumping hydraulic fluid which is not effectively used by piston and cylinder assemblies of the press.

There is hereinafter described in detail a press which is illustrative of the invention. The illustrative press comprises a lower platen to provide support for a workpiece to be operated upon by the press, a substantially rectangular upper platen movable towards or away from the lower platen, and hydraulic means for causing movement of the upper platen in the operation of the illustrative press. The hydraulic means of the illustrative press comprises a first, a second, a third and a fourth piston and cylinder assembly arranged at the corners of a rectangle. The first assembly is mechanically connected to a left-hand rear corner portion of the upper platen, the second assembly is mechanically connected to a right-hand front corner portion of the upper platen, and the third and the fourth assemblies are respectively mechanically connected to a rear right-hand corner portion and a front left-hand corner portion of the upper platen.

The cylinder of each of the piston and cylinder assemblies of the illustrative press comprises a first port and a second port so arranged that, when the first port is connected to a pump which provides a source of hydraulic fluid under pressure and the second port is connected to a collecting tank for hydraulic fluid, the assembly operates to move the upper platen towards the lower platen. Furthermore, when the second port is connected to the pump and the first port is connected to the collecting tank, the assembly operates to move the upper platen away from the lower platen.

The illustrative press also comprises valve means in the form of four solenoid-operated spring-return valves. These valves operate to control connections to the first and the second ports of the assemblies. Each valve is connected to the first port of one of the assemblies and to the second port of another of the assemblies and together the four valves determine the direction of operation of the assemblies by connecting either the first ports to the pump while connecting the second ports to the collecting tank or the second ports to the pump while connecting the first ports to the collecting tank.

The illustrative press also comprises two balancing valve means in the form of restrictor valves which are operable while the piston and cylinder assemblies are operating to move the upper platen towards the lower platen. One of the restrictor valves is operable, in response to an advance of either the left-hand rear corner portion of the upper platen or the right-hand front corner portion of the upper platen relative to the other of these portions, to restrict flow of hydraulic fluid from the second port of the first assembly, if the left-hand rear corner portion is advanced, or of the second assembly, if the right-hand front corner is advanced. Restriction of the flow of hydraulic fluid from its second port causes a slowing of the operation of the assembly so that a compensating advance of the diagonally-opposite corner portion of the upper platen is caused to occur. The other of the restrictor valves operates in identical manner to that just described but in relation to the third and the fourth assemblies. Thus, the restrictor valves operate to maintain diagonally-opposite corner portions of the upper platen equi-distant from the lower platen thereby maintaining the upper platen substantially parallel to the lower platen.

The present invention provides, in one of its aspects, a press comprising a lower platen to provide support for a workpiece to be operated upon by the press, an upper platen, and hydraulic means for causing one of the platens to move towards or away from the other platen in the operation of the press, the hydraulic means comprising a first and a second piston and cylinder assembly, the first assembly being mechanically connected to a first portion of the movable platen, and the second assembly being mechanically connected to a second portion of the movable platen, the cylinder of each assembly comprising a first port and a second port so arranged that, when the first port is connected to a source of hydraulic fluid under pressure and the second port is connected to a collecting tank for hydraulic fluid, the assembly operates to move the movable platen towards the other platen, and, when the second port is connected to a source of hydraulic fluid under pressure and the first port is connected to a collecting tank for hydraulic fluid, the assembly operates to move the movable platen away from the other platen, valve means associated with each assembly whereby the connections to the first and the second ports of the assembly are controlled to determine the direction of operation of the assembly, and balancing valve means operable, while the assemblies are operating to move the movable platen towards the other platen, in response to an advance of either of the first and second portions of the movable platen relative to the other of the portions, to restrict flow of hydraulic fluid from the second port of the assembly which is mechanically connected to the advanced portion of the movable platen thereby slowing the operation of that assembly so that a compensating advance of the other of the portions of the movable platen is caused to occur.

The present invention provides, in another of its aspects, a press comprising a lower platen to provide support for a workpiece to be operated upon by the press, and hydraulic means for causing one of the platens to move towards or away from the other platen in the operation of the press, the hydraulic means comprising four piston and cylinder assemblies arranged at the corners of a rectangle and each mechanically connected to a corner portion of the movable platen, the cylinder of each assembly comprising a first port and a second port so arranged that, when the first port is connected to a source of hydraulic fluid under pressure and the second port is connected to a collecting tank for hydraulic fluid, the assembly operates to move the movable platen towards the other platen, and, when the second port is connected to a source of hydraulic fluid under pressure and the first port is connected to a collecting tank for hydraulic fluid, the assembly operates to move the movable platen away from the other platen, valve means associated with each assembly whereby the connections to the first and the second ports of the assembly are controlled to determine the direction of operation of the assembly, balancing valve means associated with two of the assemblies which are diagonally-opposed to one another and operable, while the assemblies are operating to move the movable platen towards the other platen, in response to an advance of either of the corner portions of the movable platen which are connected to the two assemblies relative to the other of the corner portions, to restrict flow of hydraulic fluid from the second port of the assembly which is connected to the advanced corner portion thereby slowing operation of that assembly so that a compensating advance of the other of the corner portions is caused to occur, and further balancing valve means associated with the other two assemblies.

In a press as set out in either one of the last two preceding paragraphs, it is preferred that the balancing valve means comprises a valve body provided with two inlet ports each of which is connected, in the operation of the balancing valve means, to the second port of one of the assemblies, an outlet port connected to a collecting tank for hydraulic fluid, a spindle mounted for sliding movement in the valve body, the spindle acting, when moved, to close one of the inlet ports to restrict flow of hydraulic fluid as aforesaid, and a lever which is pivotally mounted on the spindle, end portions of the lever being connected through links to the portions of the movable platen which are connected to the assemblies, the arrangement being such that equal movements of the portions of the movable platen cause the lever to pivot without moving the spindle but an advance of one of the portions of the movable platen relative to the other causes the lever to move the spindle in a direction dependent upon which of the portions has advanced.

BRIEF DESCRIPTION OF THE DRAWINGS

The above and other of the various objects and several aspects of the invention will become more clear from the following detailed description, to be read with reference to the accompanying drawings, of the illustrative press aforementioned. It is to be understood that the illustrative press has been selected for description by way of example and not of limitation of the invention.

In the drawings.

Figure 1:
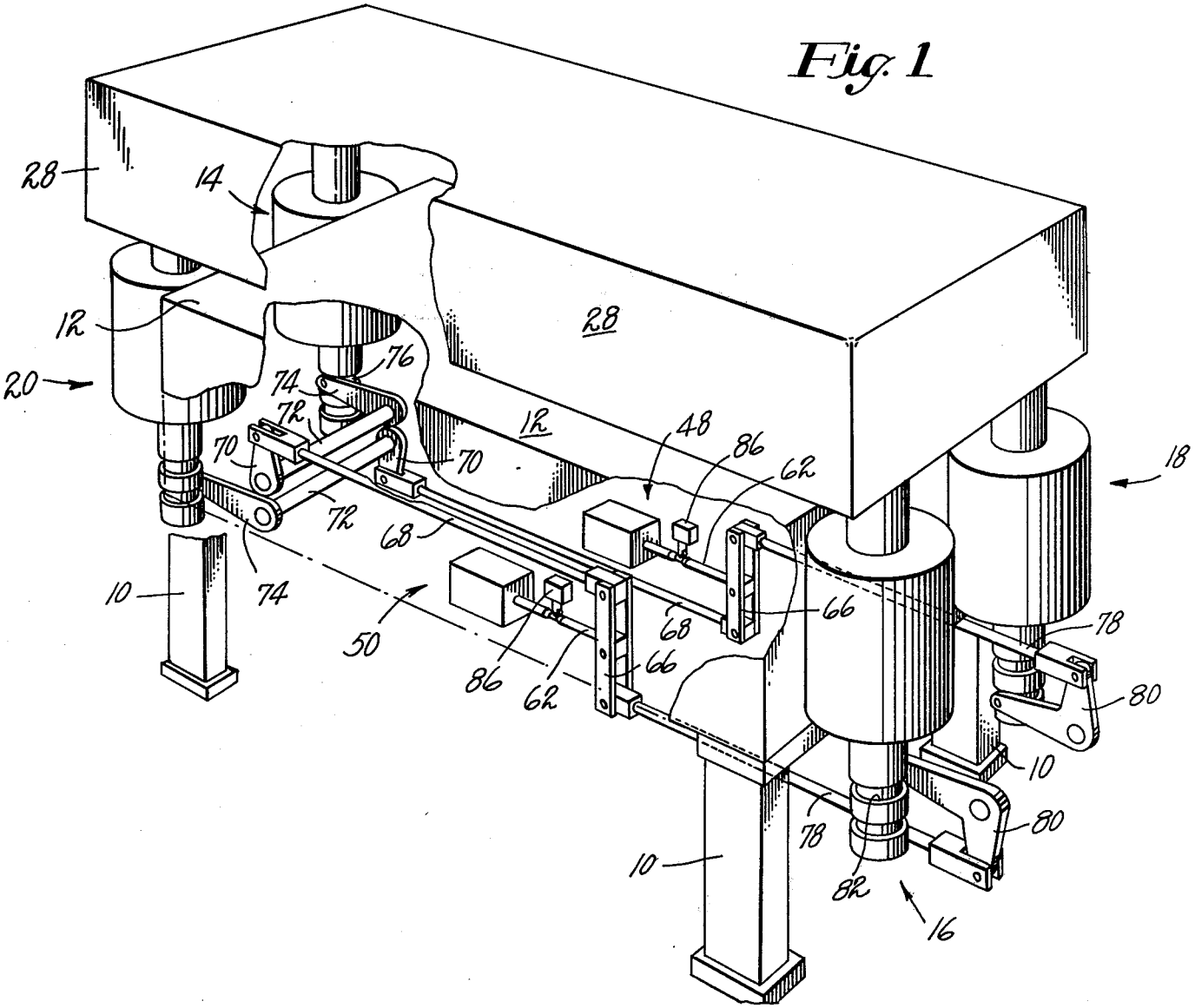
FIG. 1 is a perspective diagrammatic view, with portions broken away, of the illustrative press.

The illustrative press comprises a framework 10 (FIG. 1) which supports a fixed lower platen 12 which provides support for a workpiece to be operated upon by the press. The lower platen 12 is substantially rectangular in plan view and, adjacent corner portions of this platen, the framework 10 supports a first, a second, a third and a fourth piston and cylinder assembly, which assemblies are indicated by the reference numerals 14,16,18 and 20 respectively.

Figure 2:
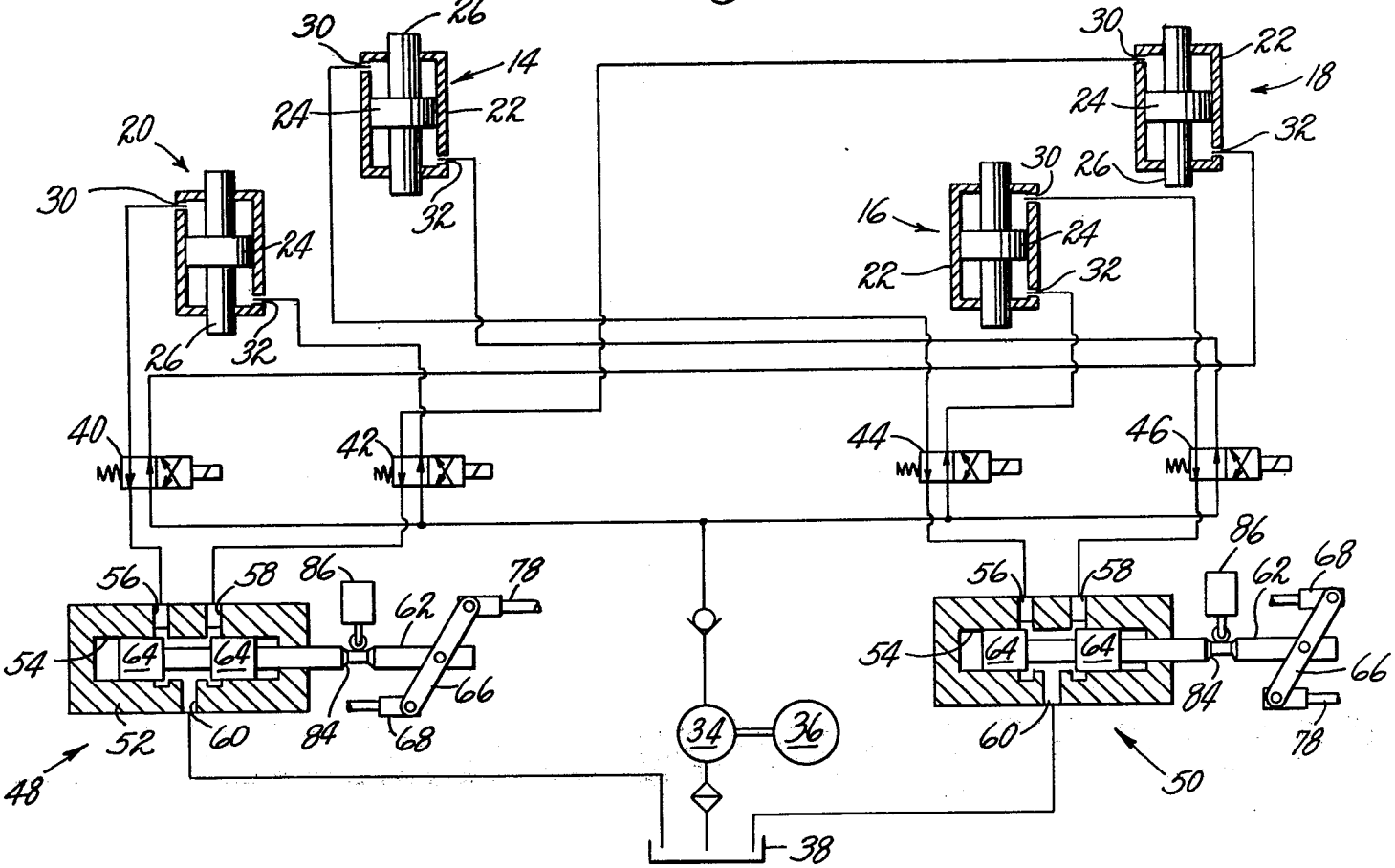
FIG. 2 is a diagrammatic representation of a hydraulic circuit of the illustrative press.

The piston and cylinder assemblies 14,16,18 and 20 are identical in construction and operation and, therefore, only the assembly 14 will be described in detail. In FIG. 2, like parts in the assemblies 16, 18 and 20 are indicated by the same reference numerals used in relation to the assembly 14. The assembly 14 comprises a cylinder 22 and a piston 24 having a piston rod 26 extending vertically of the illustrative press. An upper end portion of the piston rod 26 is mechanically connected to a left-hand rear corner portion of a rectangular upper platen 28 which overlies the lower platen 12. The piston rods 26 of the assemblies 16,18 and 20 are connected respectively to the front right-hand corner portion, the rear right-hand corner portion, and the front left-hand corner portion of the platen 28. The piston rods 26 of the assemblies 14,16,18 and 20 support the upper platen 28 and movement of the pistons 24 in the cylinders 22 causes the upper platen 28 to move towards or away from the lower platen 12.

The asembly 14 also comprises a first port 30 (FIG. 2) and a second port 32. The first port 30 is above the piston 24 and the second port 32 is below the piston 24 so that, when the first port 30 is connected to a source of hydraulic fluid under pressure, which is provided by a pump 34 driven by a motor 36 (FIG. 2), and the second port 32 is connected to a collecting tank 38 for hydraulic fluid, the assembly 14 operates to move the movable upper platen 28 towards the fixed lower platen 12. Furthermore, when the second port 32 is connected to the pump 34 and the first port 30 is connected to the tank 38, the assembly 14 operates to move the platen 28 away from the platen 12.

The illustrative press also comprises four solenoid-operated spring-return valves 40,42,44 and 46, as shown in FIG. 2. These valves are associated with each of the assemblies 14,16,18 and 20, two of the valves 40,42,44 and 46 being associated with each of the assemblies 14,16,18 and 20 and each valve being associated with two of the assemblies. The valves 40, 42, 44 and 46 control the connections to the ports 30 and 32 of each piston-cylinder assembly in order to determine the direction of operation of that assembly. The valves 44 and 46 are associated with the assemblies 14 and 16, the valve 44 being connected to the first port 30 of the assembly 14 and to the second port 32 of the assembly 16. The valve 46 is connected to the second port 32 of the assembly 14 and to the first port 30 of the assembly 16. Both of the valves 44 and 46 are also connected to the pump 34 and to the collecting tank 38.

In the operation of the illustrative press, when the valves 44 and 46 are in a rest condition thereof (shown in FIG. 2), the valve 44 connects the port 30 of the assembly 14 to the tank 38, and the port 32 of the assembly 16 to the pump 34. The valve 46 connects the port 30 of the assembly 16 to the tank 38, and the port 32 of the assembly 14 to the pump 34. Thus, the two assemblies 14 and 16 operate to move the upper platen 28 away from the lower platen 12. However, the valves 44 and 46 can be moved by energizing their solenoids to an operated condition thereof in which the ports 30 of the assemblies 14 and 16 are connected to the pump 34 and their ports 32 are connected to the tank 38 so that the assemblies 14 and 16 operate to move the upper platen 28 towards the lower platen 12. The connections and operation of the valves 40 and 42 in relation to the assemblies 18 and 20 are identical to those of the valves 44 and 46, described above, in relation to the assemblies 14 and 16. The valves 40, 42, 44 and 46 are interlocked so that they move in unison between their operated and rest conditions.

The illustrative press also comprises balancing valve means comprising two restrictor valves 48 and 50 (FIG. 2). The valve 48 is associated with the valves 40 and 42, and the valve 50 is associated with the valves 44 and 46. Since the construction and operation of the valves 48 and 50 is identical, only the valve 50 will be described in detail. Parts of the valve 48 are indicated by the same reference numerals as corresponding parts of the valve 50.

The valve 50 is mounted, as shown in FIG. 1, on the framework 10 at a front central portion thereof (the valve 48 is mounted on a rear central portion of the framework 10). The valve 50 comprises a hollow cylindrical valve body 52 enclosing a cylindrical chamber 54. A first inlet port 56 to the chamber 54 is connected to the valve 44 and a second inlet port 58 to the chamber 54 is connected to the valve 46. Thus, in the operation of the balancing valve means, the inlet ports 56 and 58 are connected, to the second ports 32 of the assemblies 16 and 14 respectively. An outlet port 60 from the chamber 54 is connected to the tank 38. Slidable within the chamber 54 is a spindle 62 which has flanges 64 thereon which are arranged to progressively close one of the inlet ports 56 and 58 as the spindle 62 moves longitudinally thereof in the chamber 54 while opening the other port 56 or 58. A lever 66 (FIGS. 1 and 2) is pivoted at a central portion thereof on the spindle 62 at a portion thereof which projects beyond the body 52.

An upper end portion of the lever 66 associated with the valve 50 is pivotally connected to a link 68 (see FIG. 1) which extends transversely of the illustrative press to the front left-hand corner of the press and is pivotally connected to a lever 70 which is fixed to a rod 72 mounted on the framework 10 for pivoting movement about a longitudinal axis thereof. The rod 72 extends rearwardly of the illustrative press towards the rear left-hand corner portion of the framework 10 where a further lever 74 projects from the rod 72 and carries a cam roller (not shown) which is received in a recess 76 (FIG. 1) in a downward projection of the piston rod 26 of the assembly 14. The arrangement is such that operation of the assembly 14 causes the lever 74 to be moved thereby pivoting the rod 72 and causing movement of the lever 70. Movement of the lever 70 causes longitudinal movement of the link 68 so that the lever 68 pivots on the spindle 62.

A lower end portion of the lever 66 is pivotally connected to a link 78 which is also pivotally connected to one arm of a bell-crank lever 80 (FIG. 1) which is pivotally mounted on the framework 10 at a front right-hand corner portion thereof. The other arm of the lever 80 carries a cam roller (not shown) which is received in a recess 82 in a downward extension of the piston rod 26 of the assembly 16. The arrangement accordingly is such that operation of the assembly 16 causes the lever 80 to pivot thereby moving the link 78 so that the lever 66 pivots on the spindle 62.

The operation of the valve 50 is as follows. When the assemblies 14 and 16 operate to move the platen 28 towards the platen 12, the links 68 and 78 are moved pivoting the lever 66 on the spindle 62. So long as the left-hand rear and diagonal right-hand front corner portions of the platen 28 which are connected to the assemblies 14 and 16 are moved together and remain equi-distant from the lower platen 12, the links 68 and 78 move through equal distances and the lever 66 pivots without causing movement of the spindle 62. However, if either of these diagonal corner portions of the platen 28 becomes advanced relative to the other portion, the links 68 and 78 are moved through unequal distances and the lever 66 is pivoted about a point away from its center and causes the spindle 62 to move longitudinally thereof. For example, if the rear left-hand corner portion of the platen 28 which is connected to the assembly 14 becomes advanced relative to the front right-hand corner portion of the platen 28 which is connected to the assembly 16, the spindle 62 is moved to the left (as shown in FIG. 2) closing the inlet port 58. The closing of the inlet port 58 restricts the flow of hydraulic fluid from the port 32 of the assembly 14 thereby causing a slowing of the operation of the assembly 14 so that a compensating advance of the right-hand front corner portion of the platen 28 is caused to occur, as the assembly 16 is now operating more quickly than the assembly 14. As the assembly 16 catches up to the assembly 14, the spindle 62 moves progressively to the right re-opening the inlet port 58 until the corner portions of the platen 28 are again equi-distant from the platen 12.

The valve 48 is operable in identical manner to the valve 50 by movement of the piston rods 26 of the assemblies 18 and 20. Like parts associated with the valve 48 are indicated by the same reference numerals as corresponding parts associated with the valve 50. Thus, the balancing valve means operates to maintain the left-hand front corner portion of the platen 28 and the right-hand rear corner portion thereof equi-distant from the platen 12 and also to maintain the right hand front corner portion of the platen 28 and the left-hand rear corner portion thereof equi-distant from the platen 12. Thus, the platen 28 is maintained substantially parallel to the platen 12.

Each of the spindles 62 has a recess 84 therein (FIG. 2) in which the plunger of a microswitch 86 is receivable. The arrangement is such that excessive movement of the spindle 62 in either axial direction, indicating serious misalignment of the platen 28, will cause the microswitch 86 to be operated. Operation of either of the microswitches 86 causes the solenoids of the valves 40, 42, 44 and 46 to be de-energized thereby causing the press to be returned to an open condition.

At the beginning of an operation, the press is in an open condition with the platens 12 and 28 at their maximum spacing. The valves 40, 42, 44 and 46 are in their rest condition and the motor 36 is driving the pump 34. After a workpiece has been positioned on the platen 12, an operator of the press actuates a control (not shown) which energizes the solenoids of the valves 40, 42, 44 and 46 thereby causing the assemblies 14, 16, 18 and 20 to move the platen 28 towards the platen 12 under the control of the valves 48 and 50. When a pressing operation has been completed by the illustrative press, the solenoids of the valves 40, 42, 44 and 46 are automatically de-energized and the assemblies 14, 16, 18 and 20 raise the platen 28 away from the platen 12.

It is found that the illustrative press maintains the platens 12 and 28 substantially parallel to one another without wasting energy in pumping hydraulic fluid since all the hydraulic fluid pumped is used in relative platen positioning by the assemblies 14, 16, 18 and 20.

Having thus described my invention, what I claim as new and desire to secure as Letters Patent of the United States is:

1. In a press comprising a lower platen for supporting a workpiece, an upper platen relatively movable toward and away from the lower platen for effecting an operation on the workpiece, hydraulic means for thus moving one of the platens and including a first and a second piston-cylinder assembly, each having a first and a second port, the first assembly being operatively connected to a first portion of the movable platen, and the second assembly being operatively connected to a second portion of the movable platen, a source of fluid under pressure, and a collecting tank for the fluid, the improvement comprising means operable, when the first port of either assembly is connected to the fluid under pressure and the second port is connected to said tank, the assembly operates to move the movable platen toward the other platen, and, when the second port is connected to the fluid under pressure and the first port is connected to said tank, the assembly operates to move the movable platen away from the other platen, valve means for controlling said ports to determine relative approach and separation of the platens, and balancing valve means operable in response to an advance of either of the first and second portions of the movable platen relative to the other of said portions to restrict fluid flow from the second port of the assembly connected to the advanced portion of the movable platen thus to slow its movement and effect a compensating advance of the other of said portions of the movable platen.

2. A press as in claim 1 wherein said movable platen is rectangular, said hydraulic means comprises four of said piston-cylinder assemblies respectively connected mechanically to diagonally opposite corner portions of said movable platen, and two pair of said balancing valve means are associated with said assemblies, one pair being associated with one pair of the diagonally oppositely acting assemblies and the other pair of said balancing valve means being associated with the other pair of the diagonally oppositely acting assemblies.

3. A press as in claim 1 or 2 wherein the balancing valve means comprises a valve body having two inlet ports respectively connected to the second port of one of said assemblies, an outlet port connected to said tank, a spindle slidable in the valve body to effect said fluid flow restriction by closing one of said inlet ports, and a lever pivotally mounted on the spindle and having means connecting its ends, respectively, to the portions of the movable platen connected to said assemblies, the arrangement being such that equal movements of said portions of the movable platen pivot the lever without shifting the spindle, and relative advance of one of the portions of the movable platen with respect to the other moves the spindle in a direction to retard said one portion.

* * * * *